US007883234B2

(12) United States Patent
Burns et al.

(10) Patent No.: US 7,883,234 B2
(45) Date of Patent: Feb. 8, 2011

(54) EMBEDDABLE LIGHTING SYSTEMS

(75) Inventors: Chester Allen Burns, Reno, NV (US); Denver Patrick Hinds, Reno, NV (US); Jonathon George Folsom, Reno, NV (US); Ryan Christopher Oddo, Reno, NV (US)

(73) Assignee: Spot Devices, Inc, Sparks, NV (US)

( * ) Notice: Subject to any disclaimer, the term of this patent is extended or adjusted under 35 U.S.C. 154(b) by 370 days.

(21) Appl. No.: 12/106,055

(22) Filed: Apr. 18, 2008

(65) Prior Publication Data

US 2009/0262522 A1 Oct. 22, 2009

(51) Int. Cl.
*E01F 9/04* (2006.01)
*F21V 31/00* (2006.01)
*H01R 33/965* (2006.01)

(52) U.S. Cl. ..... 362/153.1; 362/267; 362/645; 362/655

(58) Field of Classification Search ..... 362/153.1, 362/655, 656
See application file for complete search history.

(56) References Cited

U.S. PATENT DOCUMENTS

| | | | | |
|---|---|---|---|---|
| 1,572,214 | A * | 2/1926 | McEwing | 362/153.1 |
| 2,093,642 | A | 9/1937 | Nystuen | |
| 2,162,302 | A | 6/1939 | Greene | |
| 2,700,754 | A * | 1/1955 | McCullough | 362/153.1 |
| 2,990,177 | A | 6/1961 | Hutchison | |
| 3,163,949 | A | 1/1965 | Gley | |
| 4,025,922 | A | 5/1977 | Trawick, III | |
| 4,211,955 | A | 7/1980 | Ray | |
| 4,223,377 | A | 9/1980 | Williams | |
| 4,570,207 | A | 2/1986 | Takahashi et al. | |
| 5,041,950 | A * | 8/1991 | Tyson | 362/153.1 |
| 5,335,151 | A * | 8/1994 | Dahlberg | 362/153.1 |
| 5,406,276 | A | 4/1995 | Ogle | |
| 5,412,381 | A | 5/1995 | Dicks | |
| 5,572,202 | A | 11/1996 | Regel et al. | |
| 5,654,705 | A | 8/1997 | Houten et al. | |
| 5,743,622 | A * | 4/1998 | Ibbitson et al. | 362/153.1 |
| 5,782,552 | A * | 7/1998 | Green et al. | 362/183 |
| 6,259,375 | B1 | 7/2001 | Andras | |
| 6,384,742 | B1 | 5/2002 | Harrison | |
| 6,527,407 | B2 | 3/2003 | Gluck | |
| 6,565,239 | B2 * | 5/2003 | Rizkin et al. | 362/153.1 |
| 6,683,540 | B1 | 1/2004 | Harrison | |
| 7,023,361 | B1 | 4/2006 | Wallace et al. | |
| 7,234,892 | B2 * | 6/2007 | Raaijmakers et al. | 404/9 |
| 7,300,186 | B2 * | 11/2007 | Cuypers et al. | 362/153.1 |
| 2005/0122728 | A1 | 6/2005 | Reinert, Sr. | |
| 2006/0029466 | A1 | 2/2006 | Van Der Poel | |

FOREIGN PATENT DOCUMENTS

| | | | |
|---|---|---|---|
| FR | 2 665 914 | | 8/1990 |
| GB | 2 267 723 | A | 12/1993 |
| JP | 02274908 | A * | 11/1990 |
| WO | WO 87/00326 | | 1/1987 |

* cited by examiner

*Primary Examiner*—Alan Cariaso
(74) *Attorney, Agent, or Firm*—Alston & Bird LLP

(57) ABSTRACT

A modular in-road lighting system is easily installed in the road and is convenient for repair, replacement and maintenance. The lighting system includes at least one modular light, at least one modular cable and a control unit. The top surface of the modular light is flush with a road surface so as to avoid abrasion by passing items. The modular light includes an illumination source and a control circuitry. The illumination source and the control circuitry are configured to emit light in selected direction(s).

20 Claims, 7 Drawing Sheets

EMBEDDABLE LIGHTING SYSTEMS

BACKGROUND OF THE INVENTION

1. Field of the Invention

This disclosure relates to traffic safety and lighting systems, including more particularly to an embeddable modular light and system and methods of embedding a modular light system.

2. Discussion of the Technology

Prior approaches have employed a variety of lighting systems to illuminate roadways, airport runways or crosswalk for safety reasons.

For example, U.S. Pat. No. 6,384,742 teaches a lighting system mounted to a road surface. The lighting system protrudes above the road surface a sufficient distance to provide a visible light beam. However, the surface mounted lighting systems would be subject to scraping effects of a snow plow blade or other items passing over the lighting systems and have a tendency to be easily dislodged and destroyed.

An alternative type of lighting system is embedded in the roadway as described in a U.S. Pat. No. 6,354,714. The lighting system is installed via saw cutting and trenching. Such approach may require digging up large portions of the road and/or adjacent areas to provide a cavity large enough to accommodate the lighting system. Time consuming excavation and restoration of roads may cause traffic disruption and delay, and may also damage or weaken the road.

Moreover, maintenance, replacement or repairing procedures of lighting systems of prior approaches can be inefficient and unreliable. For example, rainwater, wear or snow may detrimentally affect the utility and reliability of the lighting systems requiring frequent repair and replacement of the lights. Since these systems usually are permanently installed, repair and replacement is both time consuming and costly. Thus, there is a need to provide a lighting system that is easy to install and maintain.

BRIEF SUMMARY

The present inventions address the foregoing problems and provide a unique and novel in-road lighting system. In one aspect, the invention includes a modular lighting system comprising at least one modular light, at least one modular cable and a control unit. The modularity of the system allows for quick and easy installation, easy expansion and quick replacement of damaged modular lights and cables. The entire modular system is preferably weatherproof. The modular light and the modular cable are preferably hermetically sealed as are the connectors electrically coupling the components. The modular cable is preferably electrically coupled to the control unit to allow the control unit to transmit and receive information to and from the modular light. The modular light is preferably configured such that when the modular light is embedded in or along a path or roadway the top surface of the modular light is flush or slightly recessed from the top surface of the roadway or path such that plows and other vehicles can pass over the modular light without damage or harm to the light or the vehicles passing over it. The modular light is also preferably configured to allow replacement of the illumination source with minimal effort.

In another aspect, the invention includes a method for installing an in-road lighting system providing one or more road cavities at desired distances for receiving one or more lights; providing a trench as deep or deeper than the road cavities for receiving one or more cables using only a circular saw. This method is preferably used for the installation of the modular light system, wherein one or more modular cables are placed within the trench and one or more modular lights are placed in the road cavities so as to make top surfaces of the modular lights adapted to be flush with or recessed from the road surface.

BRIEF DESCRIPTION OF THE DRAWINGS

The foregoing summary, as well as the following detailed description of the invention, will be better understood when read in conjunction with the included drawings. The embodiments illustrated in the figures of the accompanying drawings herein are by way of example and not by way of limitation. In the drawings.

DETAILED DESCRIPTION OF THE DRAWINGS

In the following description, certain specific details are set forth in order to provide a thorough understanding of various disclosed embodiments. However, people who read this disclosure, the drawings and the claims will recognize that the disclosed embodiments may be practiced without one or more of these specific details, or with other methods, without departing from the spirit of the inventions claimed and disclosed herein.

Figure 1:
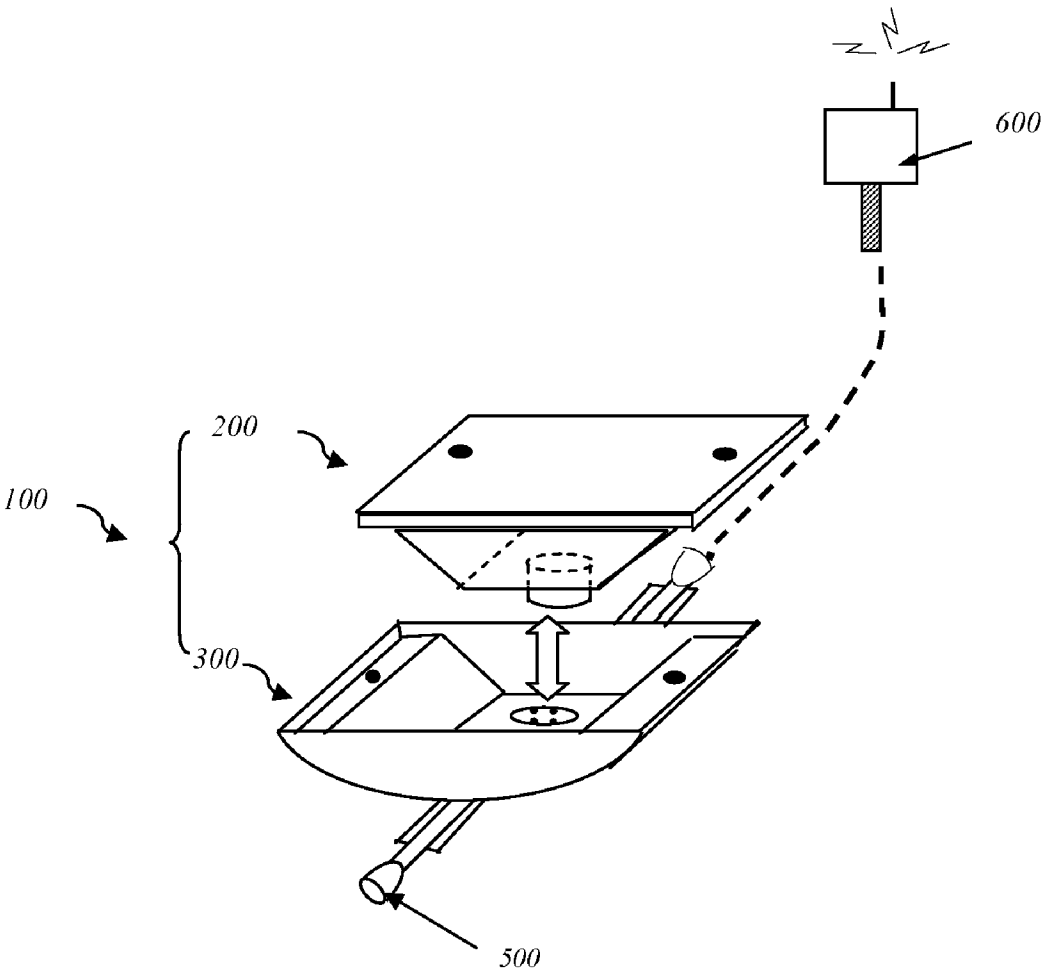
FIG. 1 shows an exploded view of a lighting system according to one illustrated embodiment.

According to one embodiment as illustrated in FIG. 1, a lighting system may comprise a modular light 100, a modular cable 500 and a control unit 600. The modular light 100 may include a hermetically sealed lighting element 200 and a lighting fixture 300. The lighting element 200, the lighting fixture 300 and the modular cable 500 will be described in the following description.

Figure 2C:
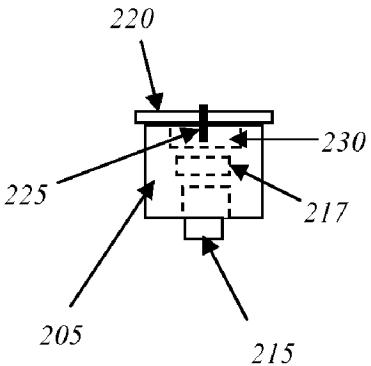
FIGS. 2A-2C are side views, a top perspective view and an end perspective view of a lighting element according to one illustrated embodiment.
Figure 2B:
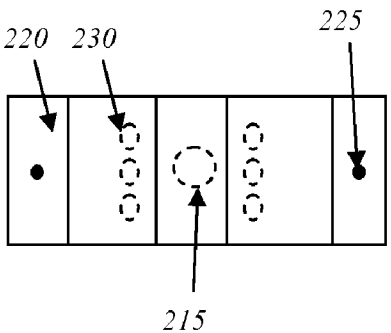
Figure 2A:
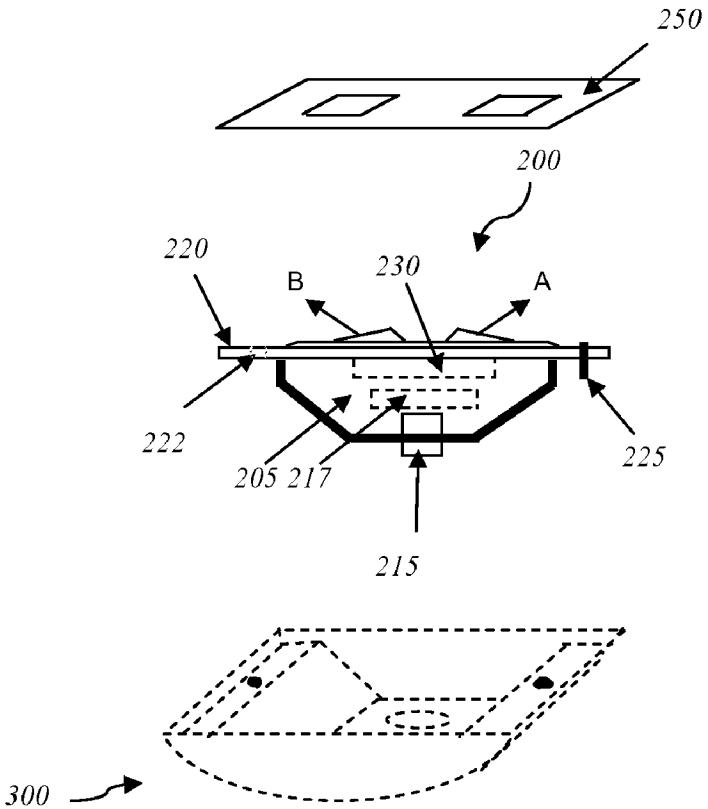

FIGS. 2A-2C show a perspective view of a preferred light fixture, and a side view, a top view and an end view of a preferred lighting element 200 according to one illustrated embodiment. The lighting element 200 preferably comprises a housing 205, control circuitry 217 carried by the housing 205 and an illumination source 230. The lighting element 200 also preferably comprises a connector 215 attached to the housing 205 and protruding from the base of the housing 205. The connector 215 preferably is electrically coupled to the control circuitry 217 and configured to receive control signals transferred from the externally located control unit 600. However, the connector 215 could provide optical or other suitable types of coupling for the transferring of information and power from the control unit 600 to the modular light 100.

Furthermore, in one embodiment the modular light 100 can comprise a transceiver with a suitable antenna for transmitting and receiving information and/or power wirelessly from the control unit 600.

The illumination source 230 is preferably electrically coupled to the control circuitry 217. Therefore, the provided control signals can be used to cause the illumination source 230 for example, to turn on or turn off in any pattern and also emit different colored light in different directions. To perform the TURN ON operation, a light beam may be emitted in the desired direction(s) (e.g., directions A and/or B) that permits the desired audience, e.g., the approaching traffic or pedestrian to see the light beam. The illumination source 230 may further comprise one or more optical components (not shown) such as LED's of different colors, halogen bulbs, simple or compound lenses or reflectors for focusing the light, and/or one or more mirrors, reflectors, or prisms for directing the light. The lighting element 200 may also preferably include an optically transparent, impact resistant and water-impermeable lens 220 from which the light beam is transmitted toward a direction of an approaching vehicle. The lens 220 also preferably has a contour that minimizes the collection or accumulation of debris that would hinder the emission of light to the desired audience. The lens 220 and the housing 205 are preferably hermetically sealed to prevent debris or liquid to affect the control circuitry 217 or illumination source 230 or that might otherwise hinder the performance or hinder maintenance of the lighting element. The lens 220 may be made detachable from the remainder of the lighting element 200. The control circuitry 217 may be further encapsulated in waterproof and/or vibration damping materials. The lens 220 is preferably made of scratch-resistant and/or weather-resistant materials and disposed on the top of the housing 205. The lens 220 may include through holes 222 for receiving fasteners, such as screws 225, to attach the lighting element 200 to the lighting fixture 300.

In some embodiments, a removable protective plate 250 can be advantageously attached to the lighting element 200, via a detachable assembly, such as screws or other like fastening means to protect the lens 220. The protective plate includes two openings that allow light to emit as normal while adding protection to the remainder of the lens 220. The protective plate 250 may be attached to protect the lens 220 from excessive wear when the location where the module light 100 is installed has a large amount of construction, maintenance or other heavy duty vehicle traffic or is installed in areas that have severe weather. The protective plate 250 may be made from one or more materials including metal, metal composite, carbon fiber, synthetic, or organic based materials.

Figure 3A:
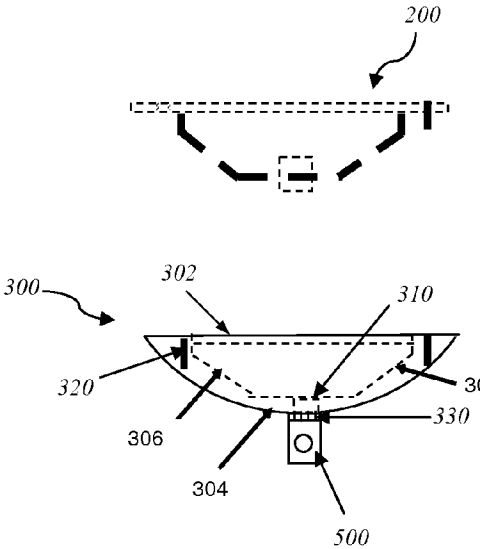
FIGS. 3A-3D are a side view, a top view, an end view and a bottom view of a lighting fixture assembled with a modular cable according to one illustrated embodiment.
Figure 3B:
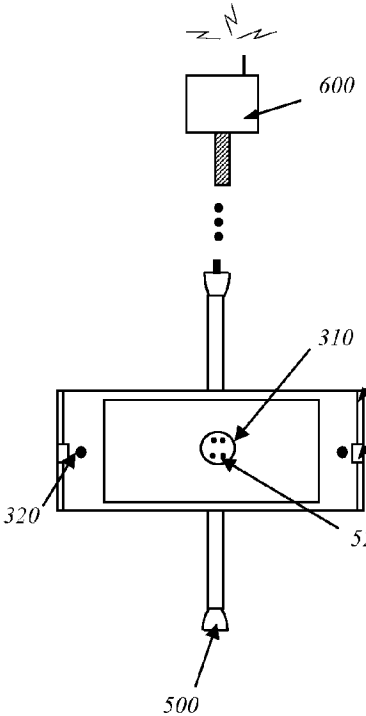
Figure 3C:
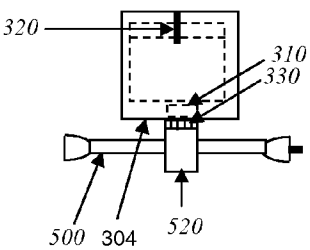

FIGS. 3A-3C show a side view, a top view and an end view of a lighting fixture according to one illustrated embodiment. With reference to FIG. 3A, the lighting fixture 300 is preferably arc-shaped in longitudinal cross section, with a relatively flat top surface 302. The width of the lighting fixture 300 is preferably less than the width of the average vehicle wheel that may ride over the lighting fixture 300 when it is installed. The lighting fixture preferably comprises an arcuate bottom plate 304 and two side plates 306 and 308 forming a cavity. The top surface preferably comprises an attachment lip around the perimeter of the lighting fixture 300. The lighting fixture 300 is preferably configured to receive the lighting element 200 so that when the lighting element 200 is inserted into the cavity the lens 220 forms the top of the modular light 100. An aperture 310 is preferably formed through the bottom 304 of the lighting fixture 300 so as to enable the connector 215 to be accessed through the aperture 310 when the lighting element 200 is inserted into the lighting fixture 300. When the lighting element 200 is inserted into the lighting fixture 300, the connector 215 preferably extends through the aperture 310 to allow the connector 215 to electrically couple with a third hermetic connector 520 of the preferred modular cable 500, even in the presence of standing water, via self-purging pins and sockets. The aperture 310 preferably includes a connector seal configured to create a water tight seal with the third hermetic connector 520. Accordingly, a hermetic seal is preferably created between the lighting element 200 and the lighting fixture 300.

A recessed peripheral support structure 314 may be formed inwardly to support the lighting element 200 within the lighting fixture 300. When the lighting element 200 is inserted into the lighting fixture 300, the lens 220 rests on the recessed peripheral support structure 314 such that the top most portion of the lens 220 is recessed slightly from the top surface 302. The lighting element 200 is thus positioned below the top surface 302 and the top surface 302 is adapted to be substantially flush with the road surface. Therefore, when snow plow blades or other items pass over the embedded light module, the lens 220 will not be scraped or worn away. Wheel noise is also minimized as vehicles travel over the modular lights. Additionally, the modular lights will not be a potential physical obstacle or tripping hazard to pedestrians or bicyclists.

To remove the lighting element 200 from the lighting fixture 300 for convenient maintenance or replacement of the lighting elements 200 once they are installed, one or more receiving grooves 315 may be formed on the support structure 314. The receiving grooves 315 are preferably formed adjacent to edge portions of the lens 220 and recessed below the lens 220 so as to permit a convenient removal of the lighting element 200. Preferably, the receiving grooves 315 may be positioned on opposite sides of the support structure 314. When the lighting element 200 is to be removed from the lighting fixture 300, a screwdriver, an operator's finger or any other appropriate items can be inserted into the receiving grooves 315 and easily lever and then lift the lighting element 200 from the lighting fixture 300.

One or more mounting screw holes 320 may be formed on the support structure 314 for receiving fasteners to mount the lighting element 200. Special security screws may be used to minimize unauthorized removal of the lighting element 200 from the lighting fixture 300. Since the lighting fixture 300 may be made from one more materials including metal, metal composite, synthetic, or organic based materials, a skirt, made from rubber materials or any other flexible material, may be employed to cover the outside surface of the lighting fixture 300 to protect against the effects of thermal and/or mechanical expansion and contraction.

Figure 3D:
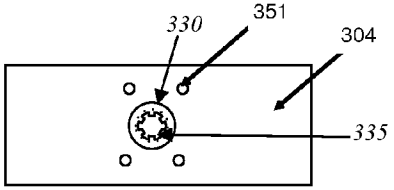

The lighting fixture 300 may comprise a sealing lock ring 330 around the aperture 310 to act as a seal and an anti-rotation element as shown in the bottom view of the lighting fixture 300 in FIG. 3D. The lock ring 330 preferably protrudes downwardly from the base of the lighting fixture 300 with a number of locking teeth 335 formed around the periphery of the lock ring 330. When the third hermetic connector 520 of the modular cable 500 is connected to the connector 215 of the modular light 100, the locking teeth 335 acts to prevent the third hermetic connector 520 of the modular cable 500 from rotating, thus locking the direction of the modular cable 500 relative to the modular light 100.

Figure 3E:
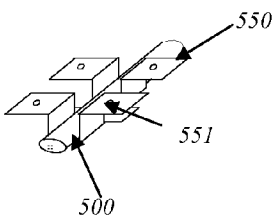
FIG. 3E is a schematic diagram of a support bracket.

A support bracket 550 is preferably used to secure the third hermetic connector 520 in the preferred lock ring 330 when the modular cable 500 assembly is attached to the lighting fixture 300. As shown in FIG. 3E, the support bracket 550 preferably includes four upright flanges with mounting holes 551 that are arranged to mate with a number of screw holes 351 formed in the bottom 304 of the lighting fixture 300 for receiving screws or other fasteners to help fasten the support bracket to the lighting fixture 300. The support bracket 550 also preferably includes two horizontal flanges that may assist with securing the lighting fixture 300 when the support bracket 550 is attached to the lighting fixture and the lighting fixture 300 is installed in the roadway or pathway.

Figure 4:
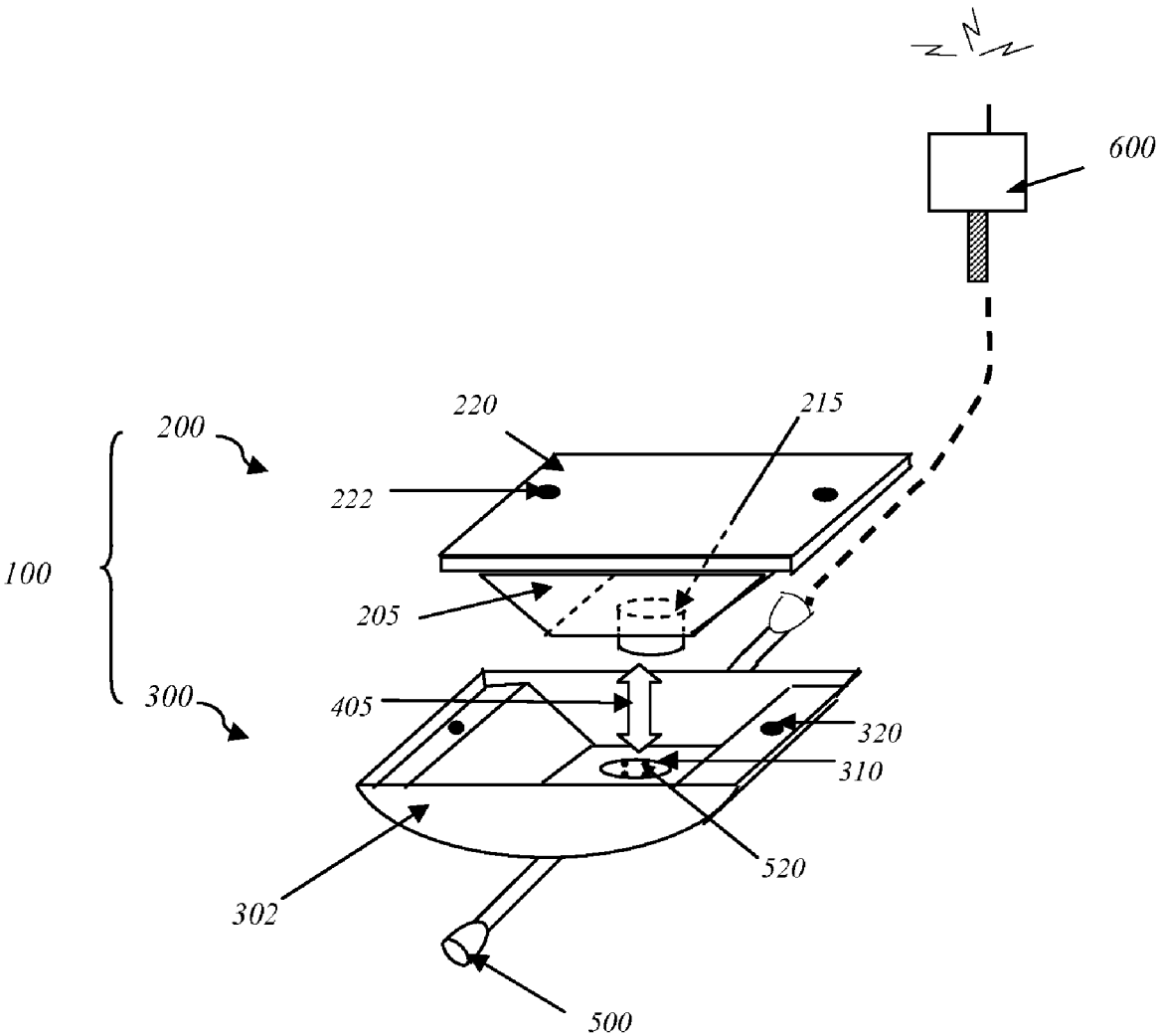
FIG. 4 is a partially exploded view of a modular light according to one illustrated embodiment.

FIG. 4 shows a partially exploded view of the modular light 100 according to one illustrated embodiment. As illustrated in FIG. 4, when the lighting element 200 is inserted into the lighting fixture 300 in a direction as indicated by an arrow 405, the connector 215 may be accessed through the aperture 310 and electrically coupled with the third hermetic connector 520 for receiving the control signals from the control unit 600. The fasteners, such as the screws 225, are engaged within the through-holes 222 and the screw holes 320 located on the lens 220 and the lighting fixture 300, respectively. If the removable protective plate 250 is provided, the fasteners may go through the holes located on the protective plate, the lens 220 and the lighting fixture 300 subsequently. In the event that some parts of the modular light 100 are damaged, the lighting element 200 may be removed and reinstated easily and quickly even in harsh and high traffic environments.

Figure 5:
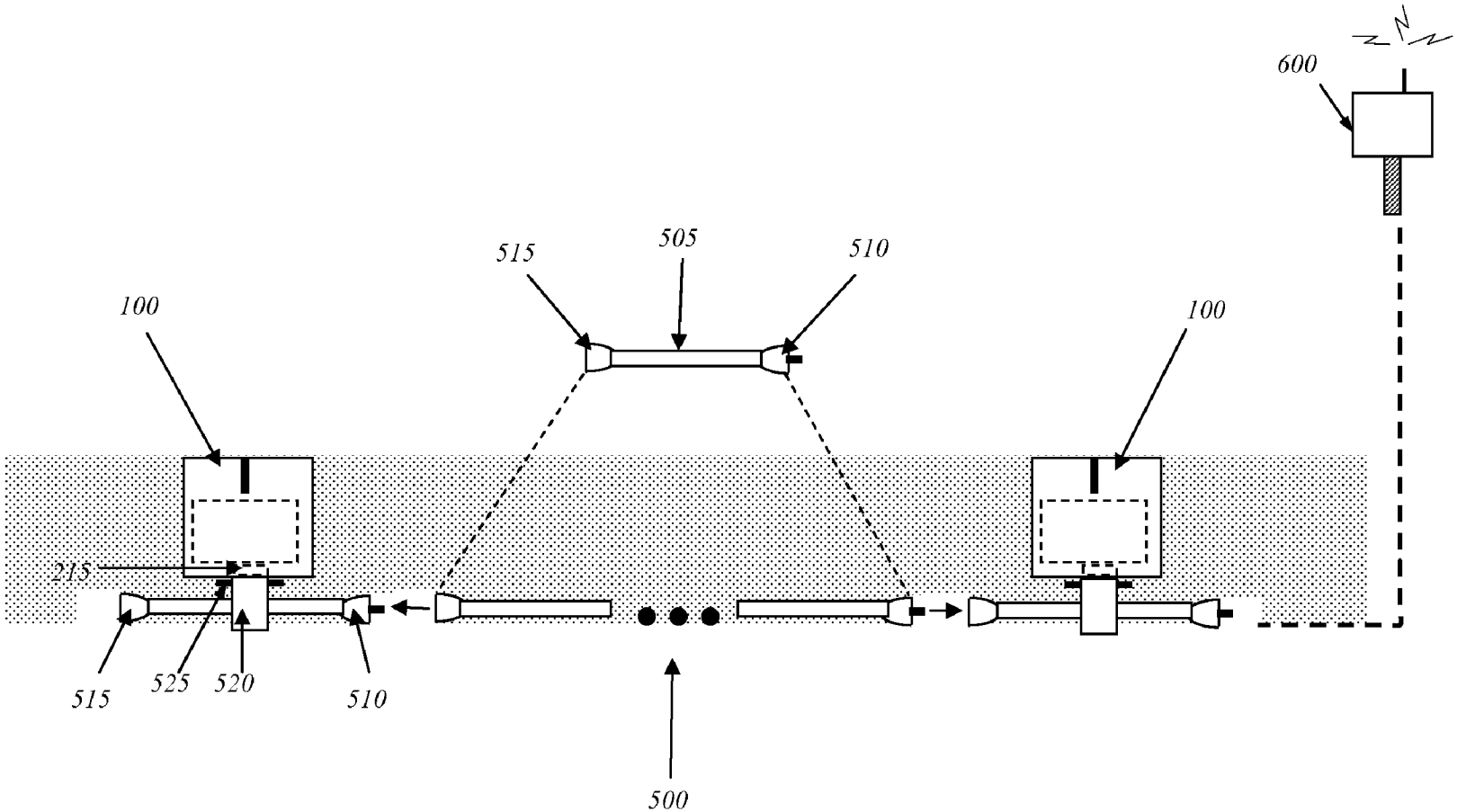
FIG. 5 is a schematic diagram of a modular cable according to one illustrated embodiment.

FIG. 5 shows a schematic diagram of a waterproof T-shape modular cable 500 used to transmit control signals and/or power from the control unit 600 to the modular light 100. Referring to FIG. 5, the preferred modular cable 500 preferably comprises a cable section 505, and first and second hermetic connectors 510 and 515. The first and second hermetic connectors 510 and 515 are attached to each end of the cable section for connecting other modular cables or a terminal device, such as the control unit 600. The first and second hermetic connectors 510 and 515 may be male and female connectors respectively. Alternatively, the first and second hermetic connectors 510 and 515 may be a pair of male connectors or female connectors. The third hermetic connector 520 is preferably deployed mid way between the first and second hermetic connectors 510 and 515 and oriented perpendicular to the longitudinal dimensions of the cable sections 505. Thus, when the third hermetic connector 520 extends through the aperture 310 and electrically couples with the connector 215 to transfer signals from the control unit 600 to the modular light 100 or in an opposite direction, the cable portions 505 may be oriented to be in a plane substantially parallel to the top surface 302 of the lighting fixture 300.

To restrict the relative rotation between the modular cable 500 and the modular light 100, the third hermetic connector 520 preferably comprises one or more tabs 525. The tabs 525 may be formed spaced apart from each other on an external surface of the third hermetic connector 520 with a predetermined angle. As the modular cable 500 is assembled with the modular light 100, the tabs 525 are pressed into and engage with the locking teeth 335 of the lock ring 330 thus fixing the rotational direction relative to the modular light 100.

Figure 6B:
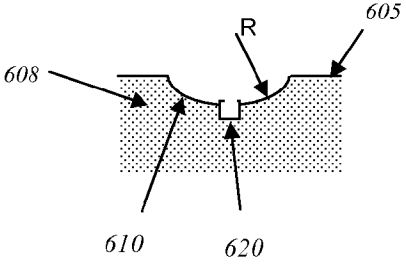
FIG. 6B is a cross-sectional side view taken along line A-A of FIG. 6A.
Figure 6C:
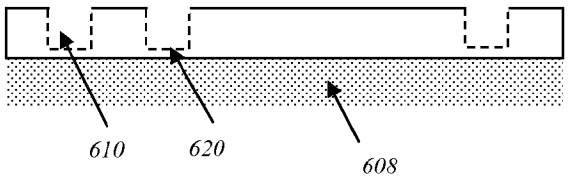
FIG. 6C is a cross-sectional end view taken along line C-C of FIG. 6A.
Figure 6A:
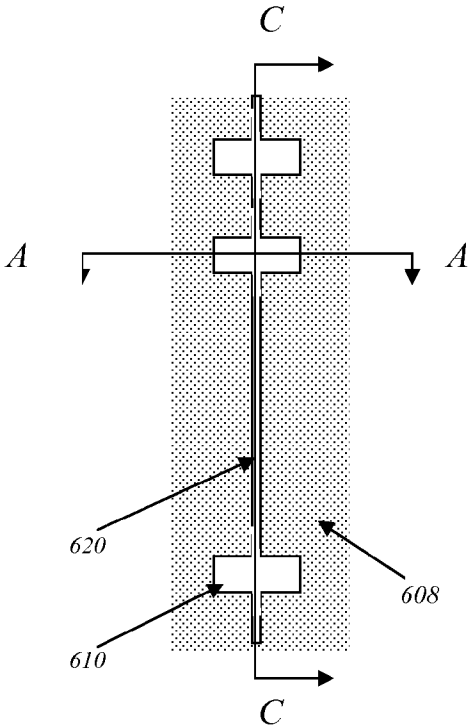
FIG. 6A is a top view of a construction of a roadway according to one illustrated embodiment.

FIG. 6A is a top view of a roadway according to one illustrated embodiment. FIG. 6B illustrates a cross-sectional side view taken along line A-A of FIG. 6A. FIG. 6C illustrates a cross-sectional end view taken along line C-C of FIG. 6A. According to the FIGS. 6A-6C, to install modular lights 100, a cement saw or a circular saw, or any other cutting tools may be used to make appropriate cuts in for example, a road surface 605, comprising for example, a concrete or asphalt surface. Accordingly, road cavities 610 are formed for receiving the modular lights 100. In a preferred embodiment, to easily install the modular lights, the radius of curvature of the arcuate bottom 304 is the same as the radius of a standard circular concrete saw. The road cavities 610 may then be excavated using a circular concrete or asphalt saw with the appropriately sized saw blade. More specifically, the circular saw blade may have the same radius R as the radius of the lighting fixture's 300 arcuate bottom 304. A cable trench 620 may be formed as deep or deeper than the road cavities 610, depending on the depth of the cavities, for the purpose of receiving modular cables 500. The trench 620 may be formed using a trench wheel or any other trenching tools. Subsequent to the construction of the road cavities 610 and the cable trench 620, the modular lights 100 and the modular cables 500 are placed as shown in FIG. 6. In one embodiment, prior to mounting the lighting element 200 to the lighting fixture 300, the lighting fixture 300 may be assembled with the modular cable 500 and support bracket 550 first. In an alternative embodiment, the modular cable 500 may be laid in the trench 620 first, then assembled with the modular light 100.

Figure 7:
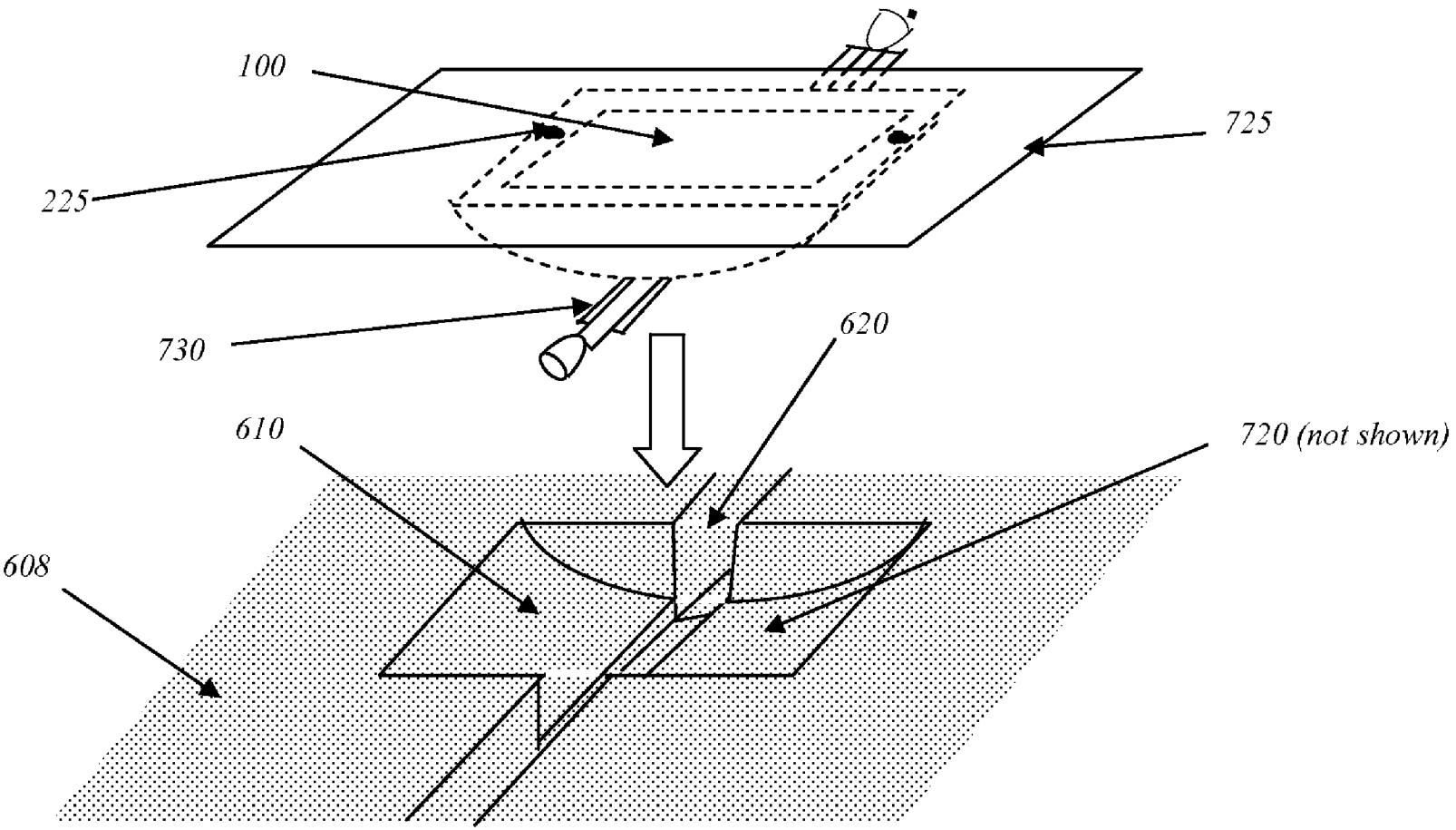
FIG. 7 is a schematic view of installing lighting systems according to one illustrated embodiment.

Referring to FIG. 7, prior to installing the modular lights 100 and the modular cables 500, specialized bonding or sealing materials, such as adhesive filler 720, may be used to secure the modular lights in the road cavity 610. To locate the modular light 100 on a vertical axis, a registration plate 725 or registration bars (not shown) may be temporarily mounted to the modular light 100 via a number of fasteners. The registration devices 725 should have a width and/or length larger than the cavity 610 to prevent the modular light 100 from sinking in the vertical direction. In addition, a rotational registration plate 730 may be employed to fix a rotational direction of the modular light 100 with respect to the modular cable 500 referring to FIG. 7. The width of the rotational registration plate 730 may be customized to fit the width of the cable trench 620. The length of the rotational registration plate 730 may be larger than the length of the modular light 100 to provide a better means for fixing the movement of the modular light 100 relative to the modular cable 500. The rotational registration plate 730 may be attached to the base of the modular light 100 using a plurality of fasteners (not shown). The fastener used to mount the first and second registration plates may, for example, include a security screw, expansion bolt, or other tamper-resistant mechanism.

In various embodiments, the modular light 100 may be activated by a multiplicity of devices via control units 600, for example, a radio frequency controller, motion sensors, photocells, flashers, pressure sensors, or traffic signal systems. The control unit 600 may be located near the road, such as on a bicycle path or sidewalk, and may or may not be mounted on a pole. In one example embodiment, the control unit 600 may comprise a push button mounted on the pole. Once the push button is pushed, the control signals may be passed through the modular cable 500 through the modular cables 500 to modular light 100 due to the electrical engagement between the third hermetic connector 520 and the connector 215. The control signals are then transferred to the illumination source to emit light in the desired direction(s), colors or patterns. In other embodiments, the lighting element 200 and the control unit 600 may comprise wireless communication systems to send/receive wireless control signals to/from each other or other control units.

It will be appreciated that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

What is claimed is:

1. A modular in-road lighting system, the lighting system comprising:

at least one modular light, at least one modular cable0 and a control unit, the modular light comprising a hermetically sealed lighting element and a lighting fixture;

the lighting element comprising:

a housing, control circuitry and an illumination source, the illumination source electrically coupled to the control circuitry and configured to emit light in one or more desired directions, the illumination source and the control circuitry housed within the housing;

a wet-mateable hermetic connector attached to the housing and electrically coupled to the control circuitry, the wet-mateable hermetic connector operable to receive control signals transferred from the control unit; and an optically transparent lens forming the top of the housing;

the lighting fixture including an aperture, the lighting fixture configured to receive the lighting element such that when the lighting element is inserted into the lighting fixture the lens forms the top of the modular light and the wet-mateable hermetic connector can be accessed through the aperture and a hermetic seal is created between the lighting element and the lighting fixture;

the modular cable comprising:

at least one cable section and three hermetic connectors, a first hermetic connector and a second hermetic connector configured to be electrically coupled with a second modular cable and a third modular cable and/or the control unit, and a third and wet-mateable hermetic connector configured to electrically couple with the control circuitry within the lighting element.

2. The lighting system of claim 1, wherein the first and the second hermetic connectors are attached to each end of the cable section, the third and wet-mateable hermetic connector deployed between the first and the second hermetic connectors and oriented perpendicular to the longitudinal dimension of the cable section.

3. The lighting system of claim 1, wherein the lighting fixture further comprises a lock ring protruding from a base of the lighting fixture, a number of downwardly projecting teeth being formed around the peripheral of the lock ring, the third and wet-mateable hermetic connector extending through the aperture and electrically coupled with the wet-mateable hermetic connector.

4. The lighting system of claim 1, wherein the lighting fixture further comprises a skirt covering an outside surface of the lighting fixture, the skirt having an opening allowing the third and wet-mateable hermetic connector to extend through the aperture and electrically couple with the wet-mateable hermetic connector.

5. The lighting system of claim 4, wherein the skirt is made of rubber material.

6. The lighting system of claim 1, wherein the lighting fixture further comprises:

a peripheral support structure for supporting the lens so as to make the lighting element rest thereon; and one or more receiving grooves, being recessed on the support structure and adjacent to the edge portions of the lens, allowing a convenient removal of the lighting element.

7. The lighting system of claim 3, wherein the modular cable further comprises one or more tabs formed spaced apart from each other on an external surface of the third and wet-mateable hermetic connector, the tabs capable of engaging with the projecting teeth of the lock ring.

8. The lighting system of claim 1, wherein the first and the second hermetic connectors comprise one of a male connector and a female connector.

9. A method for installing a modular in-road lighting system, the method comprising:

providing one or more road cavities at certain distances for receiving one or more modular lights;

providing a trench as deep or deeper than the road cavities, depending on the depth of the road cavities, for receiving one or more modular cables;

placing the one or more modular cables in the trench and the modular lights in the road cavities so as to make top surfaces of the modular lights adapted to be flush with the road surface;

electrically coupling a first and a second hermetic connectors of one modular cable with a second modular cable and a third modular cable and/or a control unit such that control signals can be communicated between the control unit and the modular light; and electrically coupling a third and wet-mateable hermetic connector with a control circuitry within the modular light.

10. The method of claim 9 further comprises cutting out a road surface and into a substructure underlying the road surface to form the one or more road cavities at certain distances for receiving one or more modular lights.

11. The method of claim 9 further comprises forming the trench as deep or deeper than the road cavities, depending on the depth of the road cavities, receiving the one or more modular cables.

12. A modular in-road lighting system, the lighting system comprising at least one modular light, the modular light comprising a hermetically sealable lighting element and a lighting fixture;

the lighting element comprising:

a housing, control circuitry and an illumination source, the illumination source electrically coupled to the control circuitry and configured to emit light in one or more desired directions, the illumination source and the control circuitry housed within the housing;

a wet-mateable hermetic connector attached to the housing and electrically coupled to the control circuitry, the wet-mateable hermetic connector operable to receive control signals transferred from a control unit; and an optically transparent lens forming the top of the housing;

the lighting fixture including an aperture, the lighting fixture configured to receive the lighting element such that when the lighting element is inserted into the lighting fixture the lens forms the top of the modular light and the wet-mateable hermetic connector can be accessed through the aperture and a hermetic seal is created between the lighting element and the lighting fixture.

13. The lighting system of claim 12 further comprises a modular cable, the modular cable comprising at least one cable section and three hermetic connectors, a first hermetic connector and a second hermetic connector configured to be electrically coupled with a second modular cable and a third modular cable and/or the control unit, and a third and wet-mateable hermetic connector configured to electrically couple with the control circuitry within the lighting element.

14. The lighting system of claim 13, wherein the first and the second hermetic connectors are attached to each end of the cable section, the third and wet-mateable hermetic connector deployed between the first and the second hermetic connectors and oriented perpendicular to the longitudinal dimension of the cable section.

15. The lighting system of claim 13, wherein the lighting fixture further comprises a lock ring protruding from the base of the lighting fixture, a number of downwardly projecting teeth being formed around the peripheral of the lock ring, the third and wet-mateable hermetic connector extending through the aperture and electrically coupled with the wet-mateable hermetic connector.

16. The lighting system of claim 13, wherein the lighting fixture further comprises a skirt covering an outside surface of the lighting fixture, the skirt having an opening allowing the third and wet-mateable hermetic connector to extend through the aperture and electrically couple with the wet-mateable hermetic connector.

17. The lighting system of claim 16, wherein the skirt is made of rubber material.

18. The lighting system of claim 12, wherein the lighting fixture further comprises: a peripheral support structure for supporting the lens so as to make the lighting element rest thereon; and one or more receiving grooves, being recessed on the support structure and adjacent to the edge portions of the lens, allowing a convenient removal of the lighting element.

19. The lighting system of claim 15, wherein the modular cable further comprises one or more tabs formed spaced apart from each other on an external surface of the third and wet-mateable hermetic connector, the tabs capable of engaging with the projecting teeth of the lock ring.

20. The lighting system of claim 13, wherein the first and the second hermetic connectors comprise one of a male connector and a female connector.

* * * * *

UNITED STATES PATENT AND TRADEMARK OFFICE

CERTIFICATE OF CORRECTION

PATENT NO. : 7,883,234 B2
APPLICATION NO. : 12/106055
DATED : February 8, 2011
INVENTOR(S) : Burns et al.

It is certified that error appears in the above-identified patent and that said Letters Patent is hereby corrected as shown below:

Column 7, line 4 (Claim 1, line 3) delete "0" after the word "cable" and before the word "and" to read as shown below:

"at least one modular light, at least one modular cable and"

Signed and Sealed this
Twelfth Day of April, 2011

David J. Kappos

David J. Kappos
*Director of the United States Patent and Trademark Office*